United States Patent [19]

Robinson

[11] Patent Number: 4,615,707

[45] Date of Patent: Oct. 7, 1986

[54] PROCESS FOR IMPROVING FASTNESS OF SULPHUR DYEING ON HYDROXY GROUP CONTAINING FIBERS

[75] Inventor: Tibor Robinson, Basel, Switzerland

[73] Assignee: Sandoz Ltd., Basel, Switzerland

[21] Appl. No.: 781,971

[22] Filed: Sep. 30, 1985

[30] Foreign Application Priority Data

Sep. 29, 1984 [DE] Fed. Rep. of Germany ..... 3435897

[51] Int. Cl.[4] ..... D06P 5/00

[52] U.S. Cl. ..... 8/496; 8/650; 8/182; 8/551; 524/195; 525/509

[58] Field of Search ..... 8/650, 496, 551, 182; 524/195; 525/509

[56] References Cited

U.S. PATENT DOCUMENTS

| | | | |
|---|---|---|---|
| 3,544,363 | 12/1970 | Rath et al. | 428/274 |
| 4,410,652 | 10/1983 | Robinson et al. | 524/195 |
| 4,436,524 | 3/1984 | Valenti | 8/551 |
| 4,443,223 | 4/1984 | Kissling et al. | 8/496 |
| 4,452,606 | 6/1984 | van Diest et al. | 8/496 |

FOREIGN PATENT DOCUMENTS 5530450 8/1978 Japan .

*Primary Examiner*—Paul Lieberman
*Assistant Examiner*—Brooks Alan Truskett
*Attorney, Agent, or Firm*—Gerald D. Sharkin; Richard E. Vila; Thomas C. Doyle

[57] ABSTRACT

A process for improving the fastness properties of a sulphur dyestuff on a substrate comprising hydroxy group-containing fibres by applying to the dyed or printed substrate the reaction product (R) of (A) the product of reacting a mono- or polyfunctional primary or secondary amine with cyanamide, dicyanodiamide, guanidine or bi-guanidine; said product containing reactive hydrogen atoms bound to nitrogen, and (B) an N-methylol derivative of a urea, melamine, guanamine, triazinone, urone, carbamate or acid amide in the presence of (C) a catalyst for the crosslinking of N-methylol compounds of the type (B) above, and subsequently carrying out a heat-curing step.

These compounds are useful for the aftertreatment of textile material.

11 Claims, No Drawings

PROCESS FOR IMPROVING FASTNESS OF SULPHUR DYEING ON HYDROXY GROUP CONTAINING FIBERS

This invention relates to the aftertreatment of a textile substrate comprising hydroxy group-containing fibres and dyed or printed with a sulphur dyestuff.

It is known from U.S. Pat. No. 4,410,652 that the wet fastness properties of dyeing with direct and reactive dyes on a hydroxy group-containing fibrous substrate such as cotton can be improved by aftertreatment with certain polycationic compounds. It has now surprisingly been found that the same products give notable improvements in the fastness properties of sulphur dyestuffs, in particular fastness to oxidative and mechanical effects.

Accordingly, the present invention provides a process for improving the fastness properties of a sulphur dyestuff on a substrate comprising hydroxy group-containing fibres by applying to the dyed or printed substrate the reaction product (R) of (A) the product of reacting a mono- or polyfunctional primary or secondary amine with cyanamide, dicyanodiamide, guanidine or bi-guanidine; said product containing reactive hydrogen atoms bound to nitrogen, and (B) an N-methylol derivative of a urea, melamine, guanamine, triazinone, urone, carbamate or acid amide in the presence of (C) a catalyst for the crosslinking of N-methylol compounds of the type (B) above, and subsequently carrying out a heat-curing step.

In the process of the present invention, the same preferences apply to components (A), (B) and (C) as are set out at Column 1 line 66 to column 8, line 20 of U.S. Pat. No. 4,410,652, the entire disclosure of which is incorporated herein by reference.

Intermediate product (A) is preferably the reaction product of diethylene triamine or triethylene tetramine with dicyanodiamide (DCDA), preferably reacted in a 1:1 molar ratio. Intermediate product (B) is preferably a hydrolysis-resistant reactive resin precursor, for example N,N'-dimethylol-4,5-dihydroxyethyleneurea, N,N'-dimethoxyethyleneurea or an N,N-dimethylol carbamate, optionally in etherified form. More preferably (B) is N,N-dimethylol-4,5-dihydroxyethylene urea. Catalyst (C) is preferably a nitrate, sulphate, chloride or dihydrogen phosphate of aluminium, magnesium or zinc, particularly magnesium chloride.

(A) and (B) are preferably reacted together in the presence of (C), or alternatively (A) and (B) may be reacted in the absence of (C) and (C) added before or during the aftertreatment process. The relative amounts of components (A), (B) and (C), if present, fall within the limits 5–40 parts by weight (A), 25–110 parts by weight (B), 1–30 parts by weight (C), calculated on the basis of the active component present. Expressed as a weight ratio, the ratio of A:B:C is 1:0.625–22:0.025–6. Preferred ranges are 10–20 parts by weight (A), 35–75 parts by weight (B) and 5–15 parts by weight (C), or 1:1.75–7.5:0.25–1.5; more preferably 1:2–3:0.5–1. The reaction product (R) may be prepared and used as described in U.S. Pat. No. 4,410,652.

Hydroxy group-containing textile fibres are primarily cellulosic fibres, which may be natural or regenerated cellulose, e.g. cotton and viscose rayon. The textile substrate may consist of cellulosic fibres alone or mixed with other textile fibres for example natural or synthetic polyamides such as wool or nylon, polyester, or polyacrylonitrile or acid-modified polyamide or polyester.

The aftertreatment process with product (R) is preferably carried out in an acidic medium, more preferably at a pH of 3 to 6, particularly at a pH of from 4 to 5.

The preferred aftertreatment application method is by padding. The dyed material may be dried before aftertreatment, whereby fixation of the sulphur dye may occur, or it may be aftertreated while damp, provided that it is able to pick up the padding liquor to a sufficient extent.

The quantities in which the product according to the invention is applied to the substrate depend largely upon the depth of the dyeing which is to be fixed. For dyeings of 1/1 standard depth on cotton the quantities used are 30–200 g/l of the padding liquor when applied at a pick-up of 70–100% of the dry weight of the goods. Preferably the quantity is 70–130 g/l for cotton, and 100–200 g/l for regenerated cellulose. For application to mixtures of cellulose fibres and synthetic fibres, the quantity to be applied is calculated on the basis of the cellulose content of the substrate. The weights of (R) given above are on the basis of the material as produced, containing 30–60% by weight water.

The heat-curing step may also be carried out as described in U.S. Pat. No. 4,410,652, for example by drying at 70°–120° C. followed by crosslinking at 130°–180° C. for 30 seconds to 8 minutes or alternatively simultaneously drying and crosslinking by heat treatment at 120°–200° C., preferably 140°–180° C. for 5 seconds to 8 minutes depending on the temperature, particularly at 170°–180° C. for 30 seconds to 1 minute.

The sulphur dyes used in the process of the invention are dyes of the class produced by thiolation of aromatic compounds with a reagent such as sodium polysulphide, especially those listed in Colour Index as C.I. Sulphur Dyes. They may be applied in the normal leuco (reduced) form, or as the oxidised form in the presence of a reducing agent, by standard methods.

Certain dyes classified as Colour Index Vat Dyes or Reduced Vat Dyes are also prepared by the thiolation of aromatic compounds, and are considered as sulphur dyes for the purpose of this application.

Although all sulphur dyes will show a certain degree of improvement of fastness properties, even better results are obtained when using certain selected groups of sulphur dyes. A preferred group of sulphur dyes is given in Table I, with the Colour Index constitution number (if available) given in brackets. The dyestuffs marked * in the third column of the table are especially preferred.

| Colour Index No. | Constitution number | |
|---|---|---|
| C.I. Leuco Sulphur Red 14 | — | |
| C.I. Leuco Sulphur Yellow 22 | — | * |
| C.I. Leuco Sulphur Orange I | 53 050 | |
| C.I. Leuco Sulphur Green 2 | 53 571 | |
| C.I. Leuco Sulphur Green 16 | — | |
| C.I. Leuco Sulphur Green 36 | — | * |
| C.I. Leuco Sulphur Blue 3 | 53 235 | * |
| C.I. Leuco Sulphur Blue 7 | 53 440 | |
| C.I. Leuco Sulphur Blue 11 | 53 235 | * |
| C.I. Leuco Sulphur Blue 13 | — | |
| C.I. Leuco Sulphur Blue 15 | 53 540 | |
| C.I. Leuco Sulphur Brown I | 53 000 | |
| C.I. Leuco Sulphur Brown 3 | — | |
| C.I. Leuco Sulphur Brown 31 | 53 280 | * |
| C.I. Leuco Sulphur Brown 52 | 53 320 | * |
| C.I. Leuco Sulphur Brown 96 | 53 228 | |
| C.I. Leuco Sulphur Black I | 53 185 | * |

-continued

| Colour Index No. | Constitution number | |
|---|---|---|
| C.I. Leuco Sulphur Black 2 | 53 195 | * |
| C.I. Leuco Sulphur Black 18 | — | * |
| C.I. Reduced Vat Blue 43 | — | |
| C.I. Leuco Sulphur Brown 37 | — | |

By aftertreatment according to the process of the invention, the fastness properties of the dyeings, particularly to oxidative and mechanical effects are improved, particularly the fastness to washing in water containing active chlorine, fastness to washing in water containing perborate, acid and alkaline perspiration fastness and wet and dry rubbing fastness. Improvement in these fastness properties is obtained without negative effect upon the light fastness properties.

The dyes in Table I all give good chlorine and perborate wash fastness at temperatures up to 60° C., and those marked * up to 95° C.

The following Examples, in which all temperatures are in degrees centigrade, illustrate the invention.

EXAMPLE 1

A 1/l standard depth dyeing of C.I. Leuco Sulphur Blue 13 on a cotton substrate is padded without intermediate drying with a solution containing 130 g/l of the product of Example 1 of U.S. Pat. No. 4,41O,652, adjusted to pH 4.2–4.4 with acetic acid, at a pick-up of 75–80%. The fabric is dried for 1 minute at 120° on a tension frame and then crosslinked for 2 minutes at 160°. The aftertreated fabric is rinsed and dried giving a dyeing with improved chlorine fastness.

EXAMPLE 2

A cotton fabric dyed with 2% (based on dry weight) of C.I. Leuco Sulphur Green 16 is padded as described in Example 1, except that the padding bath contains only 100 g/l of the product (R). Heat curing is then carried out on the tension frame by drying at 120°–130° followed by crosslinking for 30 seconds at 180°.

The resulting dyeing has excellent fastness to perborate washing.

EXAMPLE 3

A cotton fabric is dyed with 14% (based on dry weight) of C.I. Leuco Sulphur Brown 1 and treated as described in Example 2. The resulting brown dyeing shows improved dry rubbing and abrasion fastness. Addition to the padding liquor of 20 g/l of a commercial softening agent, 20 g/l of a commercial polyethylene dispersion and 1 g/l of a non-ionic wetting agent gives a dyed fabric with a softer handle.

What is claimed is:

1. A process for improving the fastness properties of a sulphur dyestuff on a substrate comprising sulphur dyed or sulphur printed hydroxy group-containing fibres, which process comprises applying to said substrate the reaction product (R) of (A) the product of reacting a mono- or polyfunctional primary or secondary amine with cyanamide, dicyanodiamide, guanidine or bi-guanidine; said product containing reactive hydrogen atoms bound to nitrogen, and (B) an N-methylol derivative of a urea, melamine, guanamine, triazinone, urone, carbamate or acid amide in the presence of (C) a catalyst for the crosslinking of N-methylol compounds of the type (B) above, and subsequently carrying out a heat-curing step.

2. A process as claimed in claim 1 in which intermediate product (A) is the reaction product of diethylene triamine or triethylene tetramine with dicyanodiamide.

3. A process as claimed in claim 1 in which intermediate product (B) is N,N'-dimethylol-4,5-dihydroxyethyleneurea.

4. A process as claimed in claim 1 in which catalyst (C) is magnesium chloride.

5. A process as claimed in claim 1 in which the sulphur dye is selected from the group consisting of C.I. Leuco Sulphur Red 14; C.I. Leuco Sulphur Yellow 22; C.I. Leuco Sulphur Orange 1; C.I. Leuco Sulphur Greens 2, 16 and 36; C.I. Leuco Sulphur Blues 3, 7, 11, 13 and 15; C.I. Leuco Sulphur Browns 1, 3, 31,37, 52 and 96; C.I. Leuco Sulphur Blacks 1, 2 and 18; and C.I. Reduced Vat Blue 43.

6. A process as claimed in claim 5 in which the sulphur dye is selected from the group consisting of C.I. Leuco Sulphur Yellow 22; C.I. Leuco Sulphur Green 36; C.I. Leuco Sulphur Blues 3 and 11; C.I. Leuco Sulphur Browns 31 and 52 and C.I. Leuco Sulphur Blacks 1, 2 and 18.

7. A process according to claim 1 wherein (R) is the product of reacting 5–40 parts by weight (A) with 25–110 parts by weight (B), and (C) is present in an amount of 1–30 parts by weight.

8. A process according to claim 2 wherein (B) is N,N'-dimethylol-4,5-dihydroxyethyleneurea, N,N'-dimethoxyethyleneurea or an N,N-dimethylol carbamate and (C) is a nitrate, sulphate, chloride or dihydrogen phosphate of aluminum, magnesium or zinc.

9. A process according to claim 2 wherein (B) is N,N'-dimethylol-4,5-dihydroxyethyleneurea and (C) is magnesium chloride.

10. A process according to claim 8 wherein the weight ratio of (A):(B):(C) is 1:1.75–7.5:0.25–1.5.

11. A process according to claim 8 wherein the reaction product (R) is applied to the substrate from an acidic medium at a pH of 3 to 6.

* * * * *